US005651237A

United States Patent [19]

De Luca

[11] Patent Number: 5,651,237

[45] Date of Patent: Jul. 29, 1997

[54] APPARATUS AND METHODOLOGY FOR PACKAGING ITEMS INCORPORATING AN INFLATABLE PACKAGING SYSTEM

[75] Inventor: Nicholas Paola De Luca, Jamaica Plain, Mass.

[73] Assignee: Novus Packaging Corporation, Jamaica Plain, Mass.

[21] Appl. No.: 467,813

[22] Filed: Jun. 6, 1995

[51] Int. Cl.[6] ..... B65B 23/00

[52] U.S. Cl. ..... 53/472; 53/449; 53/172; 53/574

[58] Field of Search ..... 53/449, 472, 474, 53/239, 172, 267, 170, 574, 558, 502, 504; 428/43

[56] References Cited

U.S. PATENT DOCUMENTS

| | | | |
|---|---|---|---|
| 4,240,556 | 12/1980 | Field | 53/472 |
| 4,596,111 | 6/1986 | Ambrose | 53/170 |
| 4,780,830 | 10/1988 | Omi et al. | 53/502 |
| 4,918,904 | 4/1990 | Pharo | 53/449 |
| 4,949,530 | 8/1990 | Pharo | 53/449 |
| 5,406,770 | 4/1995 | Fikacek | 53/502 |
| 5,427,830 | 6/1995 | Pharo | 428/43 |
| 5,447,010 | 9/1995 | Voigt | 53/472 |
| 5,447,235 | 9/1995 | Pharo | 53/472 |

FOREIGN PATENT DOCUMENTS

| | | | |
|---|---|---|---|
| 5201427 | 8/1993 | Japan | 53/170 |

*Primary Examiner*—John Sipos
*Assistant Examiner*—Ed Tolan
*Attorney, Agent, or Firm*—Rines and Rines

[57] ABSTRACT

A method of and apparatus for automatically feeding from a roll successive pairs of inflatable packaging bags each having a common intermediate inflation channel to present the end bag upon a base platform for receiving an item-to-be-packaged, and then to fold the other bag of the pair thereover to envelope the same; and then sealing the enveloping bags to provide a package of appropriate item size, inflating the bags through the inflation channel, and finally severing the inflated package from the roll.

10 Claims, 3 Drawing Sheets

APPARATUS AND METHODOLOGY FOR PACKAGING ITEMS INCORPORATING AN INFLATABLE PACKAGING SYSTEM

The present invention relates to an apparatus as well as a method of using an inflatable packaging system.

BACKGROUND OF THE INVENTION

The use of inflatable packaging systems for cushioning and thermally protecting items during storage or transport has been slowly finding increased acceptance in the market place. Such packaging systems include those described in my co-pending allowed U.S. patent application, Ser. No. 092,750 and further in pending application Ser. No. 08/344, 109 as well as those by Elkin et al. in U.S. Pat. No. 5,263,587, by Soroka et al. in U.S. Pat. No. 4,465,188, by Pharo in U.S. Pat. No. 5,272,856, and Cope in U.S. Pat. No. 4,877,334. Overall, the primary benefits of such systems over conventional polystyrene packaging include their extremely low storage volume, the low resource costs involved in making the systems, and the ease with which such systems made of high and low density polyethylene can be recycled through diffuse community recycling channels.

Although inflatable packaging systems offer tremendous economic and environmental benefits, there are serious difficulties with using such systems which make them less attractive than alternative polystyrene packaging systems in most applications.

Some of the inherent draw-backs of such inflatable packaging systems compared to use of polystyrene "peanuts" involves the associated extra steps of inserting an item within the inflatable package, filling the package with air, and, in some cases, placing the package within an external box or envelope, and further sealing the box. Use of polystyrene "peanuts" involves simply placing an item within a box, pouring the desired amount of "peanuts" inside the box, and sealing the box. In addition, while polystyrene can be used with any box or item size, inflatable packaging systems must be specifically sized for both the item-to-be-packaged as well as the external shipping or storage container.

Problems associated with using inflatable packaging systems at both manual and automated levels of use exist. At the manual level, difficulties associated with filling inflatable packages with air are most common. As a primary difficulty to using such systems manually by consumers, most individuals are unfamiliar with the flutter valves usually integrated into such systems. Common mistakes in filling involve failing to locate the valve, failing to separate and pull the valve open before filling, and further failing to inflate the package to appropriate pressure levels. Such difficulties in use only deter further acceptance of inflatable packaging systems at the consumer level.

When using inflatibles in high volume manual applications, continuous filling through the valve with an air hose or similar system proves to be a very awkward and tiresome procedure. In addition, in such high volume manual uses, the need to select the appropriately sized inflatable package and box for each product is extremely time consuming and frustrating for an operator.

Difficulties associated with using inflatable packaging in automated systems are also wide spread. In automated high speed systems which involve packaging multiple-sized items, difficulties in the automated selection of the appropriate inflatable and exterior container evolve as well as the associated problems of maintaining multiple inventory levels for various inflatibles and their corresponding boxes.

Another draw-back of using the permanent envelope style inflatable packages in automated systems, such as those by Soroka et al. in U.S. Pat. No. 4,465,188, by Pharo in U.S. Pat. No. 5,272,856, and Cope in U.S. Pat. No. 4,877,334, is the inherent complication of having to insert the item-to-be-shipped within the package. Such insertion process requires expensive film and product handling equipment and can result in damaging the package through friction with the object. One example of an automated system for packaging items with an inflatable permanent envelope style package is described in U.S. Pat. No. 4,597, 244.

The problems associated with using permanent envelope style packages can be avoided by placing the item-to-be-shipped upon the packaging and further folding the package around the product. Although both my inventions of co-pending patent applications U.S. Ser. No. 092,750 as well as Elkin et al. U.S. Pat. No. 5,263,587 can be used in such a folding procedure, Elkin's non-centralized double port filling requirement does not lend itself to use within an automated folding machine. Further, custom sizing of a given foldable package within an automated system can be easily accomplished using my said inventions and the centralized valve thereof on the package, and all sides of the flat form can be shortened without changing the functional structure of the package.

OBJECTS OF INVENTION

A primary object of the present invention, therefore, is to provide a new co-improved packaging apparatus and method that facilitate using inflatable packaging systems at both manual and automated levels of use, such system alleviating the need manually to fill the inflatable with air, allowing the use of a standard stock package for forming differently sized packages, and enabling the use of a foldable packaging system rather than an insertion process that facilitates the insertion and sealing of the inflated package within a box or envelope, and further enables the labeling of said box or envelope.

It is also an object of this invention to provide such an apparatus and system that is integratable in a high-speed in-line packaging process.

A further object is to provide such a novel apparatus that is compact to place in a location such as a store and be simple to use by a customer.

Another objective is to provide modifications of protective inflatable packages that would facilitate integration of such packages with such apparatus.

It is a further objective of this invention to provide an automated detection system of the dimensions and weight of the item-to-be-shipped which accordingly modifies the stock package to the appropriate size.

Other and further objects will be explained hereinafter and are more particularly pointed out in connection with the appended claims.

SUMMARY

In summary, from one of its aspects, the invention embraces a method of packaging items within inflatable packages, that comprises, providing a roll of adjacent and connected deflated inflatable packages; feeding the roll to present the end package thereof for use upon a platform; measuring the size and weight of an item placed upon the package and to be placed therein; folding the package around the item; moving sealing bars in accordance with said measuring to seal the package around the item with appropriate size package; filling the package with air; and severing the inflated package from the roll.

The apparatus embodies the following: a holder for a roll of connected, adjacent, un-filled inflatable packages, the form of such package and roll being described in my said co-pending patent application U.S. Ser. No. 092,750, a conveyor system to locate the next-in-line end package of the roll for use, a platform for placing the item-to-be-packed on the open portion of the package, a detection system to measure the size of the item, a folding bar to fold the package into its closed form around the item, movable sealing bars to permanently seal the package around the product at the correct size, an air filling system to automatically secure the flutter valve and fill the package with air at the correct pressure, and a separation bar to separate the package from the roll stock.

In using the primary apparatus in manual applications, an item is first placed upon the deflated, automatically indexed and positioned package (end bag of the package pair of bags, say 29 in FIG. 3) and the fold-over bar is manually pressed down over the object. This motion overlays the other bag 36 or second half of the package about the axis of the common inflation channel 24, and overlaying the item and actuates the dimension detection system. The heat sealing bars are thereafter automatically adjusted transversely around the product and further activated so as to permanently envelope and seal the appropriate size package over the object. The package is subsequently automatically inflated and separated from the stock material; the waste material being collected by a vacuum system for recycling. Placement of the inflated package within a box is further accomplished manually. The apparatus resets itself for the next item by advancing the next package to the appropriate position.

In high speed, high volume packaging applications, the primary unit might be incorporated with secondary systems such as a robotic item placing system and an automated boxing and labeling system. In addition, the movement of the folding bar would be motorized.

Preferred and best mode designs and forming techniques are hereafter described.

DRAWINGS

The invention will now be described in connection with the accompanying drawings in which:

FIG. 1 is a three dimensional view of the primary apparatus incorporating the mechanical elements required for its operation in conjunction with the packaging system described in my allowed patent U.S. Ser. No. 092,750.

FIG. 2 is a block diagram illustrating the apparatus described in FIG. 1 incorporated with a robotic item placement system and a boxing and labeling system to form a high speed-automated packaging system.

FIG. 3 is a view of one package as described in my allowed co-pending patent application U.S. Ser. No. 092,750 with modified edges for use within the film handling mechanism of the apparatus.

FIG. 4 is a view of the package as described in FIG. 3 with indications of different sizing configurations formed in using the apparatus of FIG. 1.

DESCRIPTION OF PREFERRED EMBODIMENT (s)

Figure 1:
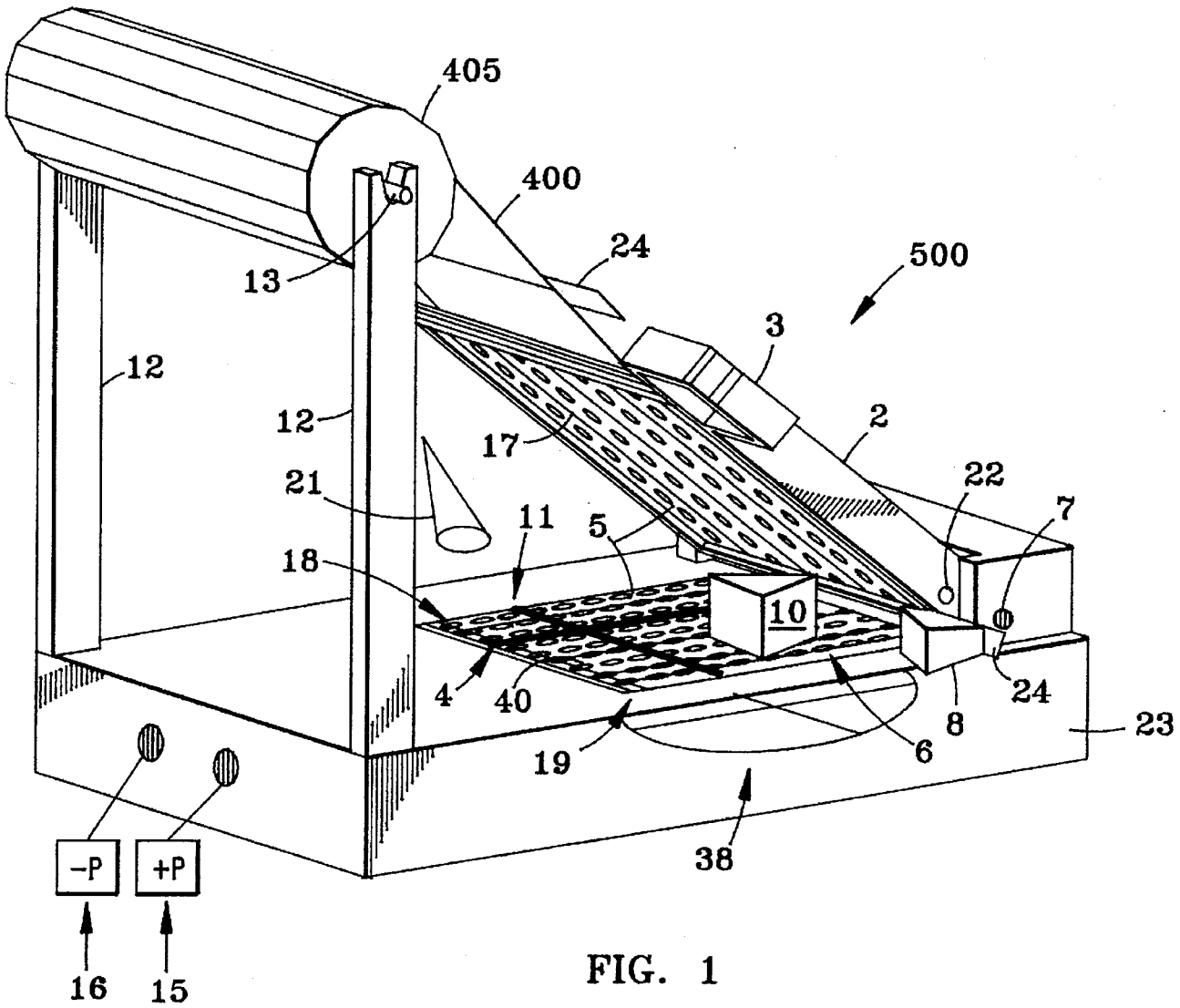

Referring to FIG. 1, a roll of packages 405, composed of adjacently connected inflatable packaging units 400, further described in my said patent application Ser. Nos. 092,750 and 08/344,109, is mounted on supports 12 using shaft 13. The packages each comprise a pair of adjacent inflatable bags 29, 31 (FIG. 3) intermediately joined by a common inflatable channel with an external air filling valve 24. Units 400, each comprising a pair of such inflatable bags, are fed along the conveyor 5 which might employ a vacuum 15 to hold the packages to top surface 17 and bottom surface 40. A pin drive system 6 is also mounted along front and back edges 19 and 18 of conveyor 5 to assure proper alignment of the two-bag packages 400 upon surfaces 17 and 40. This alignment assuring proper positioning of the valve 24 at the air-filler port 8 located near the pivot 7 between arm 2 and base 3 where the common inflation channel of the bags of each pair is located when the end bag is presented upon the base platform 40. Automated advance of the in-line packages 404 is accomplished with help of both the conveyor 5 and the tractor feed 6 and is indexed using the optical positioner 22.

In using system 500 of FIG. 1, an object 10 is located on the exposed surface of package 400 which lays upon surface 40 of conveyor 5. Arm 2 is pushed down, pivoting at 7, thus bringing surface 17 to surface 40, and in conjunction, folding the attached second half of package 400, over object 10. It is important to note that surfaces 17 and 40 are bendable so as to permit closure of the package around object 10. The dimension and weight detection system 38 further measures the overall dimensions and weight of object 10; such system 38 possibly comprised of stress sensors, optical imaging, or sound imaging systems. With the dimension and weight of the object 10 determined by system 38, package 400 is appropriately sealed along its peripheral edges 36, 37, and 35 shown in FIG. 4 using the width and length sealing elements 4 and 11. Sealing elements 4 and 11 are preferably impulse heat sealing elements which move to the proper location upon direction by the detection system 38.

Figure 4:
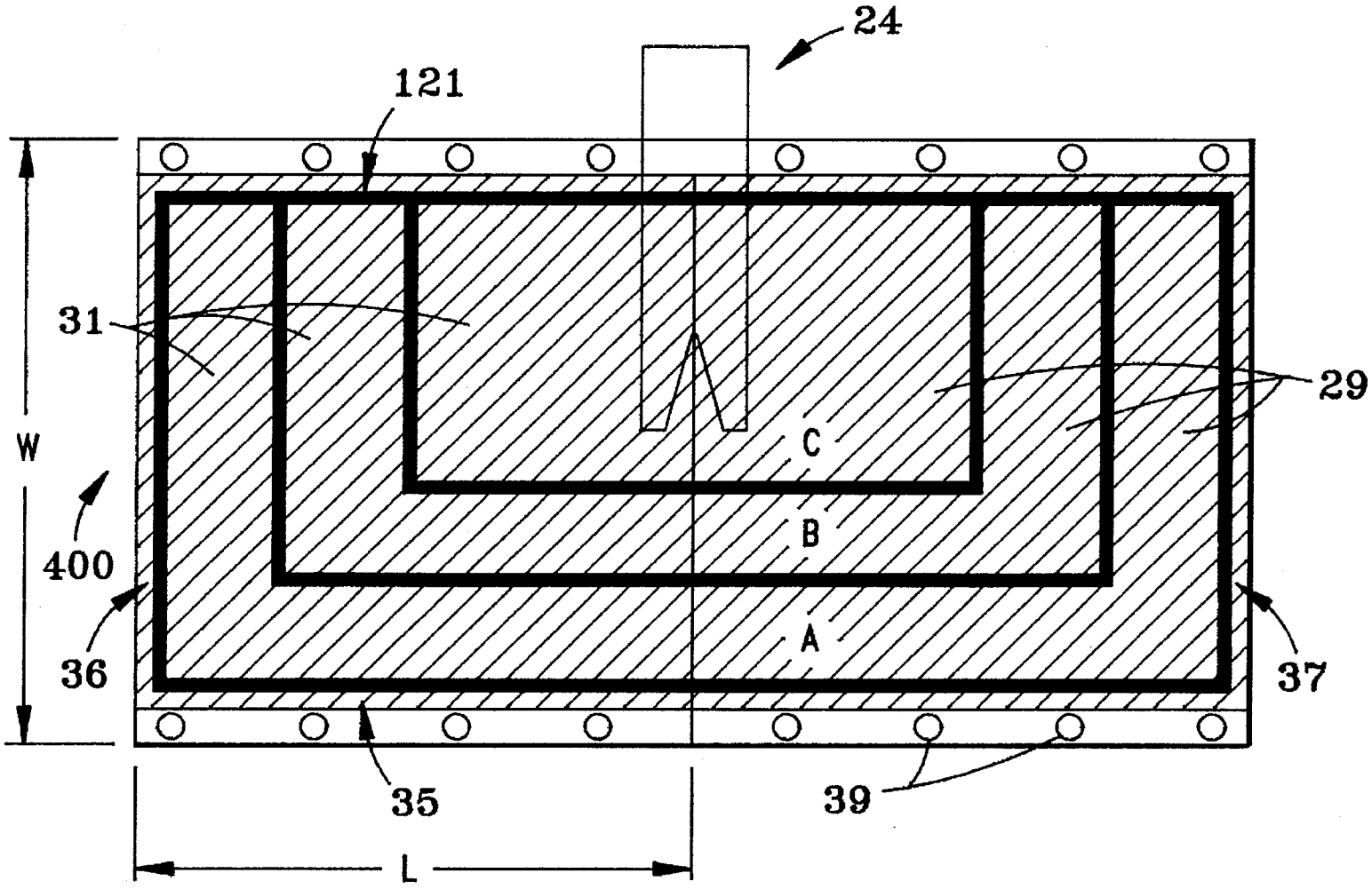

As illustrated in FIG. 4, specially sized packages can be formed using the movable heating elements 4 and 11. The heat-sealing element 4 is positioned perpendicular to peripheral edges 36 and 37 and moved parallel to edge 35 so as to form the appropriate width W of the package. Heating element 11 is perpendicular to edge 35 and moved parallel to edges 36 and 37 so as to form the appropriate length of the package. It must be noted that edges 36 and 37 lay atop one another at the time of folding and therefore, L is defined as the length of the folded section. In addition, sealers 4 and 11 may be designed so as to melt and separate the sealed package from the raw roll stock 405 and subsequent package 400. The "scrap" separated material which lies between the new seals A, B, or C and previous edges 35, 36, and 37 may be collected using vacuum tube 21 for recycling.

With the proper heat-sealing around the package completed, the package's air chambers 31 and 29 may be inflated using the air filler apparatus 8 through valve 24. The air filler is attached to a positive pressure source 16 and is also connected to an automatic shut-of regulator to insure proper pressurization. In addition, the filler apparatus 8 may incorporate a sealing element to permanently seat the valving mechanism 24 of the package 400.

Figure 2:
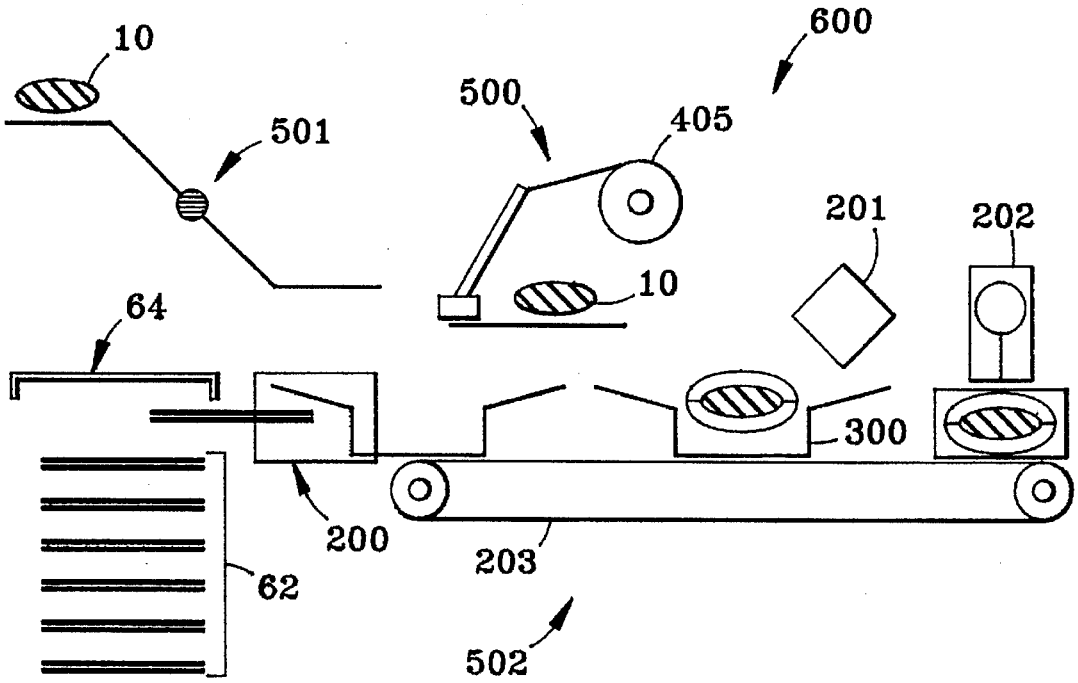

In order to integrate system 500 within a high-speed automated packaging system 600, as shown in FIG. 2, a robotic item placing system 501, as well as a boxing system 502 might be added. In addition, all manual operations required in using system 500, such as pulling down frame arm 2, would be retrofitted with automatic motorized or pneumatic systems. In such an operation, the robotic placing system 501 positions an item 10 upon surface 40 of system 500. The item 10 is packaged using the inflatable packaging system 400, as described previously, and further positioned within an open box 300, which is placed under the package using conveyor 203. Box 300 is further closed using folder and sealer 201 and subsequently labeled or printed using 202. Labeling system 202 might be interfaced with detection system 38 so as to print appropriate pricing labels, shipping labels, weight characteristics, or dimensional characteristics. In some applications the exterior box or envelope might be integrated with the roll 405 and therefore labeler printer 202 may be attached directly to system 500. Folded boxes 62 may be positioned within the unfolder 200 using positioner 64.

Figure 3:
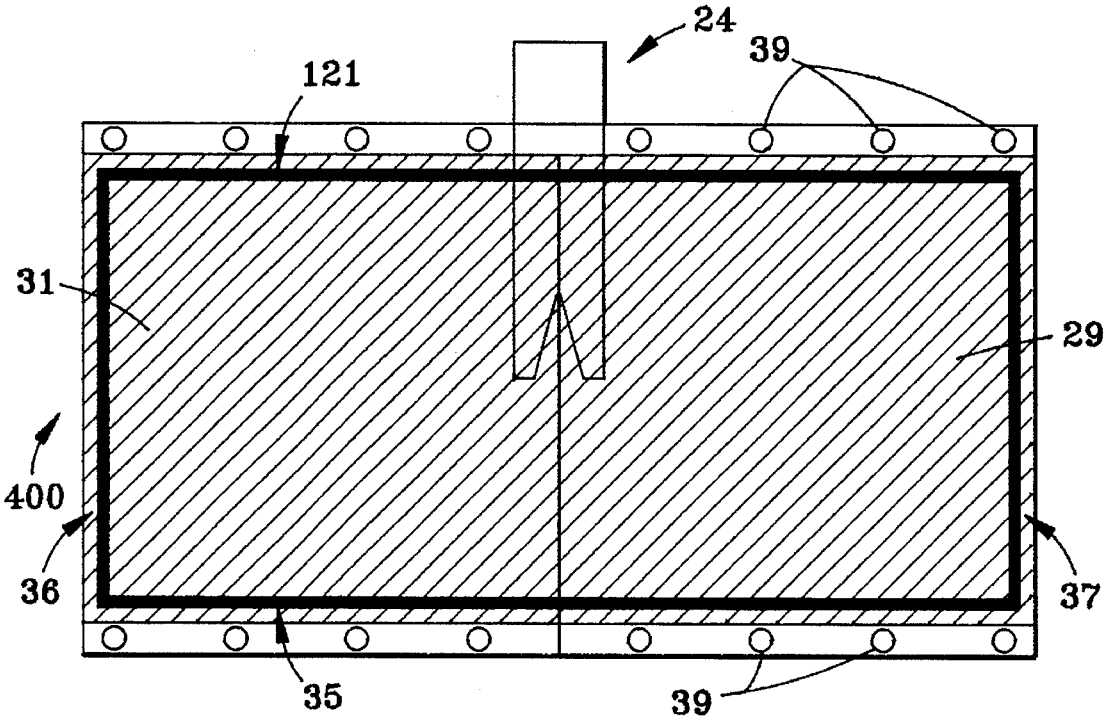

FIG. 3 illustrates modification of an inflatable package as described in my said co-pending applications, which incorporates perforations 39 which work in conjunction with the pin drive system 6 of FIG. 1. Perforations 39 are equally spaced apart and most appropriately located along edges 121 and 35; though may be placed in equal distances between packages 400 along edges 36 and 37.

Further modifications will occur to those skilled in the art, and such are considered to fall within the spirit and scope of this invention as defined in the appended claims.

What is claimed is:

1. A method of packaging items within inflatable packages, that comprises, providing a roll of adjacent and connected deflated inflatable packages; feeding the roll to present the end package thereof for use upon a platform; measuring the size and weight of an item placed upon the package and to be placed therein; folding the package around the item, wherein the inflatable package comprises a pair of inflatable adjacent bags joined intermediately by a common inflation channel substantially centrally therebetween, and the item is placed on one bag fed onto the platform, and the folding overlays the other bag over the item about the common channel as an axis; moving sealing bars to seal the package around the item with an appropriate measured size package; filling the pair of bags with air through said common channel and severing the inflated package from the roll.

2. A method as claimed in claim 1 and in which the filling is effected through an external valve cooperative with the common inflation channel and extending laterally outward of the folded bags.

3. A method as claimed in claim 1 and in which the package bag edges are indexed to enable movement on to and off the platform.

4. A method as claimed in claim 2 and in which the inflated package enveloping the item is automatically robotically boxed and labeled.

5. Apparatus for packaging items with inflatable packages of successive adjacent pairs of deflated bags connected in a continuous roll, each pair of bags being joined substantially centra intermediately by a common inflation channel therebetween; means for feeding the end pair of bags of the roll to present the end bag of such pair upon a base platform to receive thereupon the item-to-be-packaged; means for pivotally folding the other bag of such pair about the common channel as an axis to enfold the item; means for operating sealing bar(s) extending transversely across the platform to seal the item between the bags of such pair; means for thereafter introducing air into the common inflation channel to fill the bags as an inflated package enveloping the item; and means for severing the inflated package from the roll.

6. Apparatus as claimed in claim 5 and in which means is provided for measuring the size and weight of the item placed upon the end bag of the pair presented upon the platform and means for controlling position and operation of the sealing bar operating means to seal an appropriate size package for the item.

7. Apparatus as claimed in claim 5 and in which said common inflation channel is provided with an external filling valve extending to the side of the platform for filling the package bags.

8. Apparatus as claimed in claim 5 and in which the bag edges are perforated to cooperate with indexing means provided along the platform.

9. Apparatus as claimed in claim 6 and in which the said other bag of each pair is initially held positioned at an acute angle to the base platform while overlayed about the common inflation channel as an axis by a frame carrying the sealing bar extending transversely across the platform.

10. Apparatus as claimed in claim 9 and in which the transverse position of the sealing bars is adjusted in accordance with the measured size and weight of the item to provide an appropriate size package for the item.

* * * * *